US006848123B2

(12) United States Patent
Lim

(10) Patent No.: US 6,848,123 B2
(45) Date of Patent: Feb. 1, 2005

(54) SHEET WINDING MACHINE FOR A TOILET STOOL

(76) Inventor: Hongsoon Lim, 414, SK APT - Factory, 223-28, Sangdaewon-dong, Chungwon-ku, Seongnam city, Kyoungki-do (KR)

( * ) Notice: Subject to any disclaimer, the term of this patent is extended or adjusted under 35 U.S.C. 154(b) by 37 days.

(21) Appl. No.: 10/422,122

(22) Filed: Apr. 24, 2003

(65) Prior Publication Data

US 2003/0200600 A1 Oct. 30, 2003

(51) Int. Cl.[7] ..... A47K 13/14
(52) U.S. Cl. ..... 4/243.2
(58) Field of Search ..... 4/243.1, 243.2

(56) References Cited

U.S. PATENT DOCUMENTS 1,761,637 A * 6/1930 Muller ..... 4/243.2
5,253,372 A * 10/1993 Boker ..... 4/243.2
5,685,024 A * 11/1997 Chu et al. ..... 4/243.2
6,076,198 A * 6/2000 Meierdierck ..... 4/243.2

* cited by examiner

*Primary Examiner*—Charles E. Phillips
(74) *Attorney, Agent, or Firm*—F.Chau & Associates, LLC

(57) ABSTRACT

Disclosed herein is a sheet winding machine for a toilet stool, the machine comprising a sheet supplier and a sheet collector mounted on opposite ends of an under plate, said under plate being installed at a rear end of a toilet seat mounted on a toilet bowl, wherein the sheet supplier comprises first and second supports mounted at both sides of the under plate and a sheet supply roll releasably mounted at an upper side between the first and the second supports, wherein the sheet collector comprises first and second support plates at both sides of the under plate, a third support plate laterally mounted at the second support plate, a driving force transferring unit mounted at an external side of the third support plate with a plurality of sprockets and chains, a driving force switching and transferring unit meshed via a plurality of gears between the second and the third support plates, a sheet feeding unit so mounted as to allow a rotating roller and a contact roller to abut between the first and the second support plates, a sheet winding unit mounted at an upper side between the first and the second support plates for a sheet winding roll to be releasably operated, a toilet seat lift unit mounted at a front side of the sheet feeding unit to allow a lifter to be operated, and a pedal device connected to the transferring unit to provide a driving force to the feeding unit and the winding unit.

14 Claims, 15 Drawing Sheets

SHEET WINDING MACHINE FOR A TOILET STOOL

BACKGROUND OF THE INVENTION

1. Field of the Invention

The present invention relates to a sheet winding machine for a toilet stool, and more particularly to a sheet winding machine for a toilet stool adapted for supplying and collecting a vinyl sanitary sheet placed for each user for sanitary use of a toilet seat at a toilet bowl.

2. Description of the Prior Art

Generally, it is sanitarily unclean for a user to sit on a toilet seat which was used by a previous user. In order to solve the unsanitary problem, an electric winding device operated by a driving motor was disclosed where each user places a sheet on a toilet seat and collects the sheet after use. There is a disadvantage in the conventional device thus described in that capacity for storing sanitary sheets therein is limited to result in frequent changes of the sanitary sheets, and when batteries equipped therein have done their time, it is impossible to use the device unless the batteries are instantly replaced for new ones. There is another disadvantage in that maintenance is costly and the device becomes frequently out of order.

SUMMARY OF THE INVENTION

The present invention is provided to solve the aforementioned problems and it is an object of the present invention to provide a sheet winding machine for a toilet stool configured to increase a storing capacity of sanitary sheets for a longer use and to accurately adjust the length of a toilet sheet (hereinafter referred to as sheet) for collection.

Another object of the present invention is to reduce the maintenance cost at a large scale and to minimize failure rates.

In accordance with the objects of the present invention, there is provided a sheet winding machine for a toilet stool, the machine comprising a sheet supplier and a sheet collector mounted on opposite ends of an under plate, said under elate being installed at a rear end of a toilet seat mounted on a toilet bowl, wherein the sheet supplier comprises first and second supports mounted at both sides of the under plate and a sheet supply roll releasably mounted at an upper side between the first and the second supports, wherein the sheet collector comprises first and second support plates at both sides of the under plate, a third support plate laterally mounted at the second support plate, driving force transferring means mounted at an external side of the third support plate with a plurality of sprockets and chains, driving force switching and transferring means meshed via a plurality of gears between the second and the third support plates, sheet feeding means so mounted as to allow a rotating roller and a contact roller to abut between the first and the second support plates, sheet winding means mounted at an upper side between the first and the second support plates for a sheet winding roll to be releasably operated, toilet seat lift means mounted at a front side of the sheet feeding means to allow a lifter to be operated, and a pedal device connected to the driving force transferring means to provide a driving force to the sheet feeding means and the sheet winding means.

BRIEF DESCRIPTION OF THE DRAWINGS

For fuller understanding of the nature and objects of the invention, reference should be made to the following detailed description taken in conjunction with the accompanying drawings in which.

DESCRIPTION OF THE PREFERRED EMBODIMENTS

Figure 1:
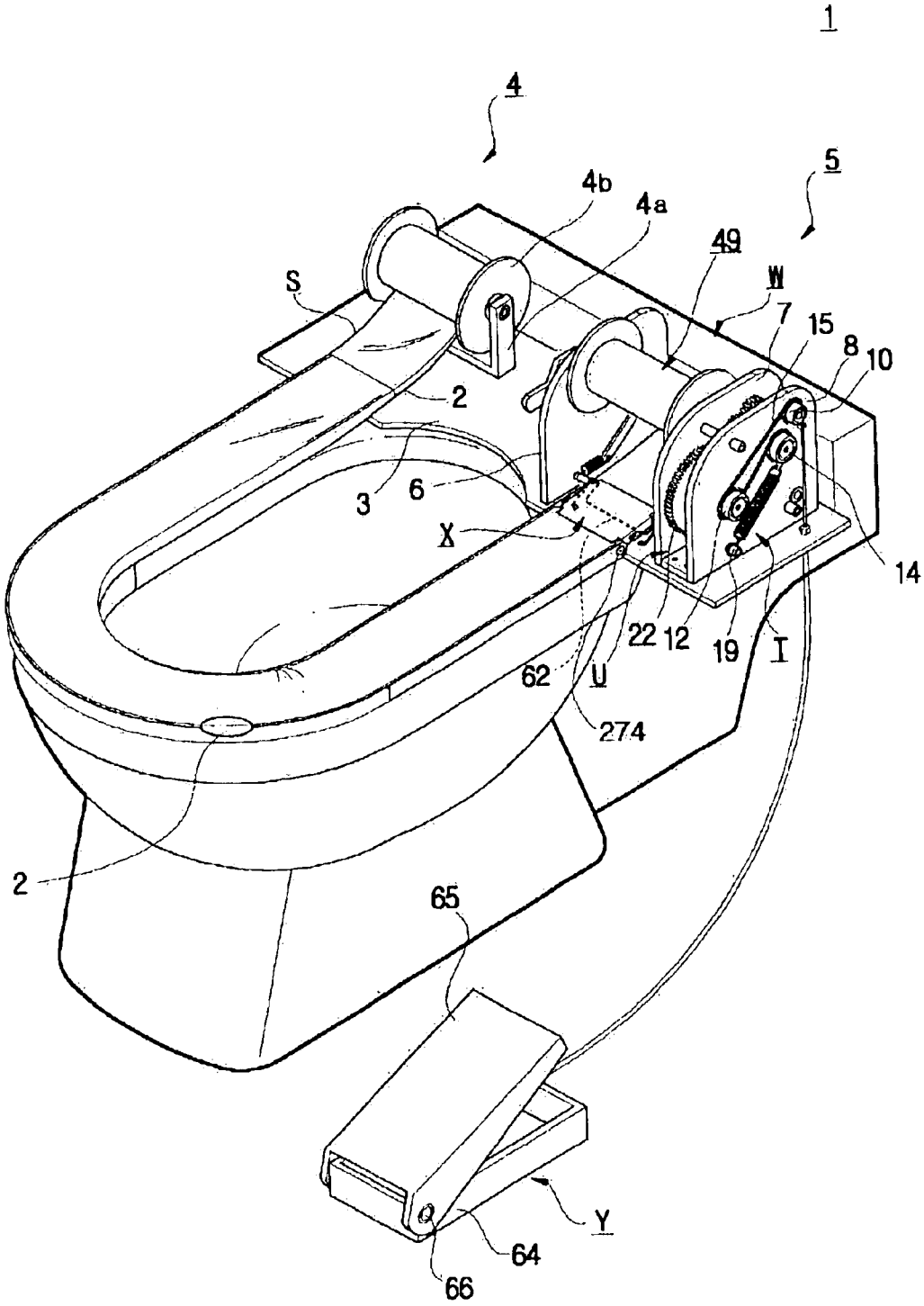
FIG. 1 is a perspective view for illustrating a sheet winding machine for a toilet stool according to a first embodiment of the present invention.
Figure 2:
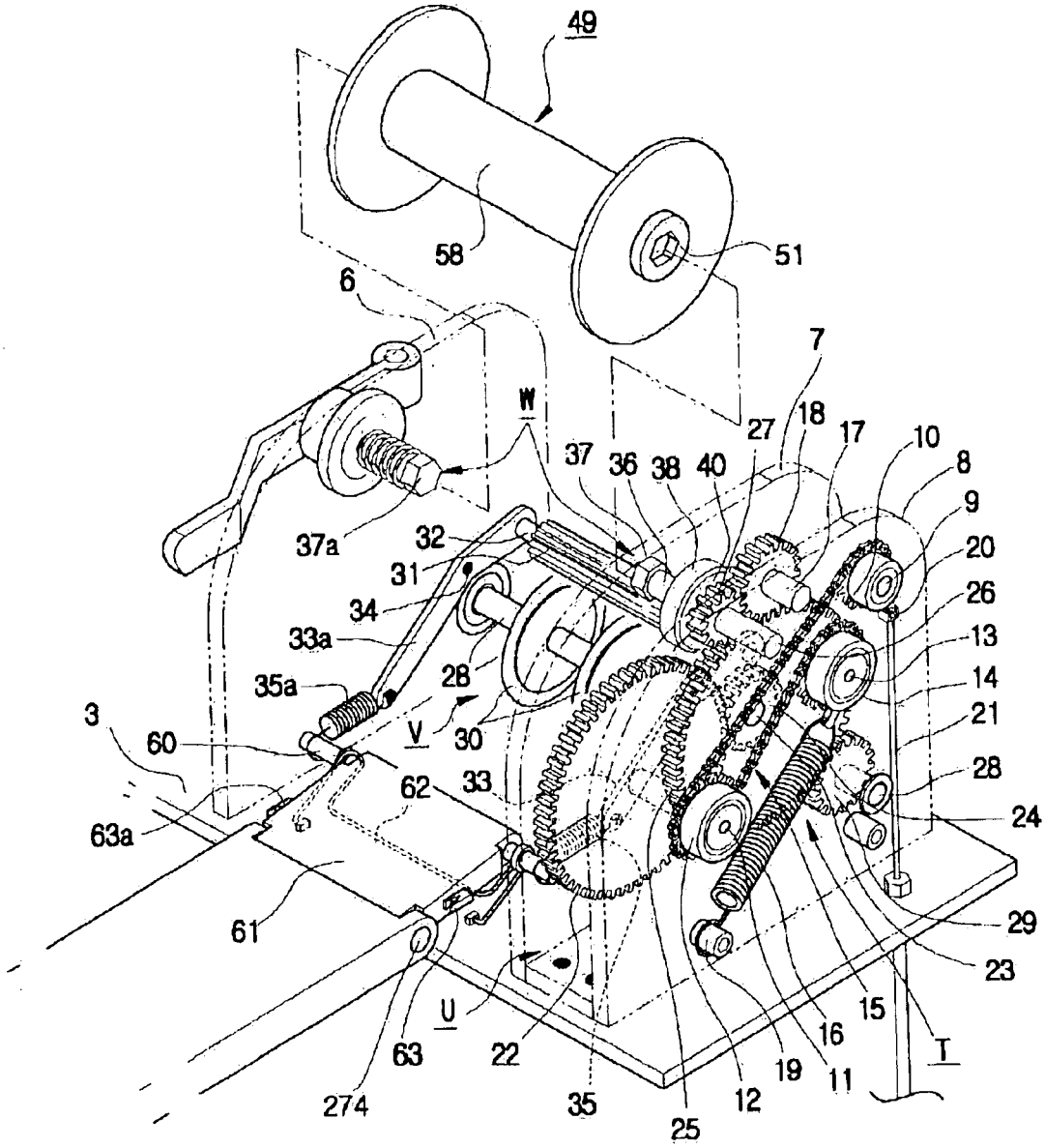
FIG. 2 is a perspective view for illustrating construction and operation of a sheet collector for a sheet winding machine for a toilet stool shown in FIG. 1.
Figure 3:
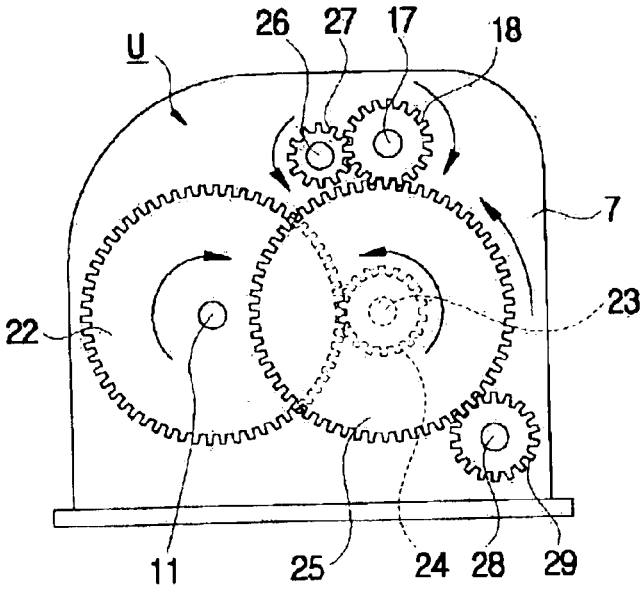
FIG. 3 is a side view for illustrating a meshed gear state of driving force switching and transferring means at the sheet winding machine for a toilet stool of FIG. 1.
Figure 4:
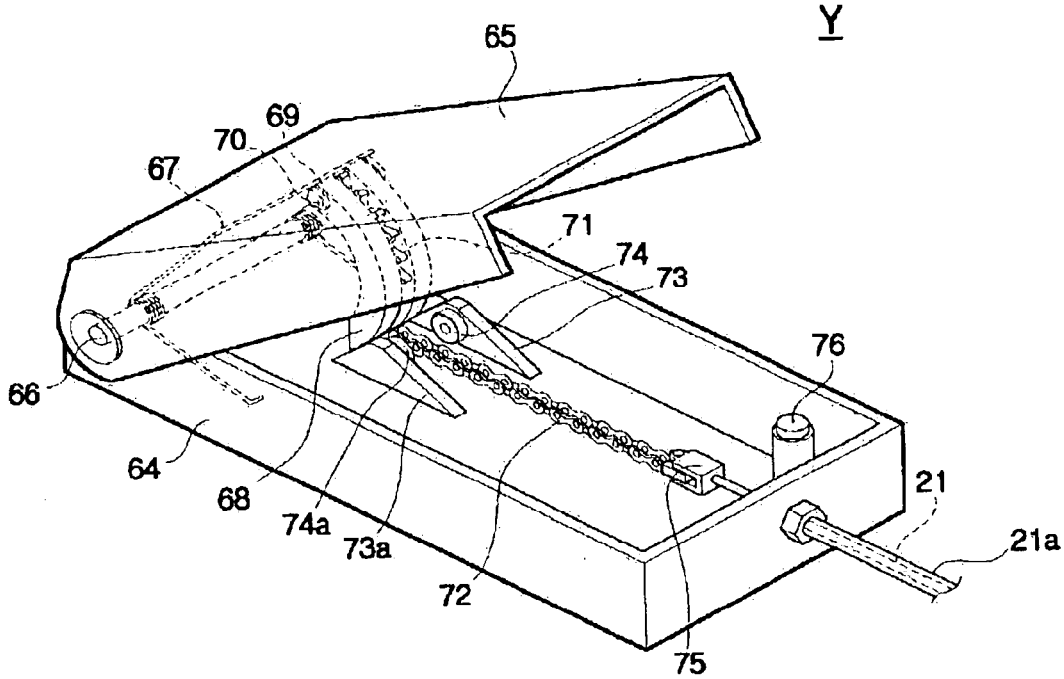
FIG. 4 is a perspective view for illustrating a pedal device of the sheet winding machine for a toilet stool of FIG. 1.

Hereinafter, preferred embodiments of the invention will be described in detail with reference to the accompanying drawings.

As illustrated in FIGS. 1 to 4, a sheet winding machine for a toilet stool according to the embodiments of the present invention includes a toilet seat 2 and a toilet stool 1. There is provided an under plate 3 that is installed at a rear end of the toilet seat 2 mounted on the toilet stool 1, and a sheet supplier 4 and a sheet collector 5 mounted on opposite ends of the under plate 3.

The sheet supplier 4 has a first and a second supporter 4*a* (shown at only one side of FIG. 1) mounted on the under plate 3. A sheet winding roll 4*b* is releasably mounted on an upper side between the first and the second supporter 4*a*.

Sheet S is wounded on the sheet winding roll 4*b*, and inserted from an end of the seat 2 at a setting process and introduced to the sheet collector 5 along the U shaped seat 2.

The sheet collector 5 includes driving force transferring means (T), driving force switching and transferring means (U), sheet feeding means (V), sheet winding means (W), toilet seat lift means (X), and a pedal device (Y) connected to the driving force transferring means (T) for providing the driving force to the sheet feeding means (V) and the sheet winding means (W).

The driving force transferring means (T) comprises a support sprocket 10 mounted at an external rear upper side of a third support plate 8 and axially rotated around a first axle 9, a rotating sprocket 12 disposed at an external front lower side and axially rotated around a rotating axle 11, and a guide roller 14 equipped underneath the support sprocket 10 for axially rotating around a second axle 13. Furthermore, the support sprocket 10, the rotating sprocket 12 and the guide roller 14 are connected via chains 15 and the chain is connected at one end thereof to a coil spring 16. The coil spring 16 is secured at one end thereof to a keeper 19 fixed at an external front lower side of the third support plate 8. The chain 15 is connected at the other side thereof to a cable 21 via a connector 20.

The driving force switching and transferring means (U) comprises a driving gear 22 axially mounted at a rotating axle 11 which is the same axle as the axle mounted with the rotating sprocket 12, where the driving gear 22 is axially connected at one side thereof to a first transmission gear 24 via a second axle 23 to thereafter be meshed to the driving gear 22 and a second axle 24, which is the same axle as that of the first transmission gear 24, is axially connected to a second transmission gear 25. On an upper side of the second transmission gear 25, an upper driven gear 18 is meshed to the second transmission gear 25 via a shaft 17 and a winding gear 27 is axially connected to a lateral surface of the upper driven gear 18 via a third axle 26 but distanced from the second transmission gear 25 and meshed to the upper driven gear 18. The second transmission gear 25 is axially mounted at a lower side thereof to a lower driven gear 29 via a fourth axle 28 to be meshed to the second transmission gear 25. The fourth axle 28 is horizontally and rotatively mounted among first, second and third support plates 6, 7 and 8.

The sheet feeding means (V) comprises a rotating roller 30 axially connected to a mid-section of a fourth axle 28 which is the same axle to which a lower driven gear 29 is connected. The rotating roller 30 is axially connected thereon via a fifth axle 32 to a contact roller 31 which is simultaneously rotated by a turning effect of the rotating roller 30 by being contacted to the rotating roller 30. The fifth axle 32 is connected at both ends thereof to levers 33 and 33*a*. The levers 33 and 33*a* are rotatively connected via a rotation axle 34 to inner wall of the first and second support plates 6 and 7, and are connected thereunder to tension springs 35 and 35*a*.

The sheet winding means (W) comprises first and second coupling protruders 37, 37*a* which are respectively mounted at upper sides of the first and second support plates 6 and 7. Between the first and second coupling protruders 37 and 37*a* there is releasably mounted a sheet winding roll 49 having first and second coupling grooves 51. The first coupling protruder 37 is connected to a sixth axle 36 which is in turn connected to a magnetic housing 38. The magnetic housing 38 is fixedly mounted with a bearing and the third axle 26 is axially connected to a steel disc 40 absorbed to the bearing by magnetic force.

The toilet seat lift means (X) comprises a lifter 61 mounted via a support axle 60 between the first and the second support plates 6 and 7, and a resilient spring 62 mounted at both ends of the lifter 61 via the support axle 60. The lifter 61 is connected at a front tip end thereof via a connecting shaft to the toilet seat 2, and the front tip end surface of the lifter 2 and the tip end surface of the toilet seat 2 are mutually contacted by surface contact. The support axle 60 is connected at both lateral sides thereof with the tension springs 35 and 35*a*, and the lifter 61 is secured at both ends thereof with knives 63 and 63*a* for cutting sheets (S).

The pedal device (Y) comprises a pedal unit 65 mounted at an upper side of a base plate 64 via a hinge axle 66 and a resilient spring 67, and the pedal unit 65 is rotatively disposed at a predetermined position of the inner side thereof with an arc press pad 68 via a hinge piece 69 and a hinge axle 70. The arc pressing pad 68 is formed at a central external surface thereof with a sprocket 71 and is fixedly connected at a tip end thereof with a chain 72 connecting to a cable 21. The floor of the base plate 64 is axially connected at both sides thereof to bearings 74 and 74*a* which are archedly pressed to the arc press pad 68 by support frames 73 and 73*a*. The other tip end side of the chain 72 is connected via a connector 75 to the cable 21. The base plate 64 is vertically disposed at a predetermined position thereof with a support stopper 76. The cable 21 is covered with a tube for protection thereof.

Now, operation of preferred embodiments thus constructed according to the sheet winding machine for a toilet stool will be described.

First of all, while sheets (S) are placed via the toilet seat 2 on the sheet winding roll 49 of the sheet collector 5 and on the sheet supplier 4 mounted on both sides of the toilet stool 1, a user steps on the pedal unit 65 of the pedal device (Y) in order to use the toilet stool 1. At this time, the pedal unit 65 pushes the resilient spring 67 to be rotated and descended via a hinge axle 66 to simultaneously lower the arc press pad 68. The arc press pad 68 is lowered to pull the chain 72 and the cable 21. According as the cable 21 is pulled by the action of the pedal device (Y), tension is generated at the coil spring 16 to pull the chain 15. The chain 15 is fed toward a direction of the support sprocket 16 being supported and pulled and at the same time, is guided along the guide roller 14 to rotate the rotating sprocket 12 axially connected to the rotating axle 11. When the rotating sprocket 12 is rotated, the driving gear 22 axially connected to the rotating axle 11 which is the same axle of the sprocket 12 is also rotated. When the driving gear 22 is rotated, the first transmission gear 24 is rotated to the opposite direction of the driving gear 22 and the second transmission gear 25 is rotated by the rotation of the first transmission gear 24. At this time, the upper driven gear 18 and the lower driven gear 29 meshed to the upper and lower sides of the second transmission gear 25 are respectively rotated in the opposite direction of the second transmission gear 25. When the lower driven gear 29 is rotated, the rotating roller 30 axially connected to the fourth axle 28 which is the same axle as that of the lower transmission gear 29 is rotated. When the rotating roller 30 is rotated, the contact roller 31 which is tangent therewith is also rotated and the sheet (S) is pulled toward the toilet seat 2 by the turning effect and adhering force of the rotating roller 30 and the contact roller 31 to be fed to the rear and to be supplied to the sheet winding roll 49 at the upper side. At the same time, the upper driven gear 18 and the winding meshed thereto are rotated and the steel disc 40 axially connected to the third axle 26 which is the same one as that of the upper driven gear 18 and the winding gear 27 is rotated. Simultaneously, the magnetic housing 38 is rotated to prompt the first coupling protruder 37 axially connected toward the sixth axle 36 to be rotated. When the first coupling protruder 37 is rotated, the sheet winding roll 49 coupled via the first and second coupling grooves 51 at the second coupling protruder 37*a* is rotated to wind the sheet (S) collected at a paper pipe 58 insertedly disposed at a shaft 50 of the sheet winding roll 49. When the sheet (S) is pulled to be wound on the paper pipe 58, the knives 63 and 63*a* mounted at both sides of the lifter 61 cut the both sides of the sheet (S) to prevent the sheet (S) from being hitched at the support axle 60 and to allow same to slip out of the toilet seat 2 and the lifter 61, thereby allowing to be wounded on the paper pipe 58. Meanwhile, when foot is pulled off the pedal unit 65 which has been trod, the pedal unit 65 and the arc press pad 68 are lifted and returned to an original position by the resilience of the adhered resilient spring 67.

As a result, the sheet winding machine for a toilet stool according to the embodiment of the present invention thus constructed can be constructed with sanitary sheets having a large capacity to allow each user to mount a sheet on the toilet seat according to the mechanical operation of each component and to use a sanitary toilet seat.

Figure 5:
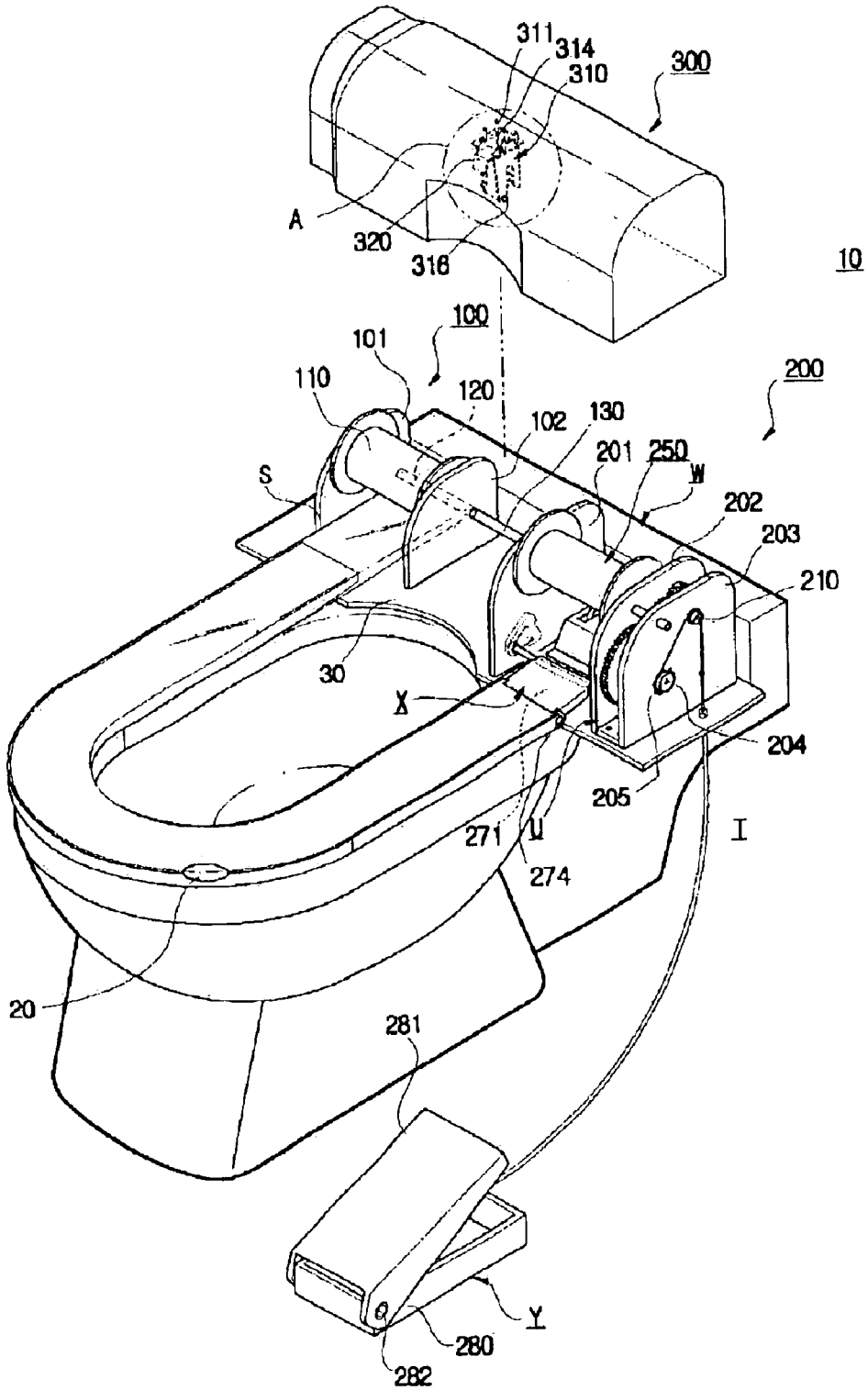
FIG. 5 is a perspective view for illustrating a sheet winding machine for a toilet stool according to a second embodiment of the present invention.
Figure 6:
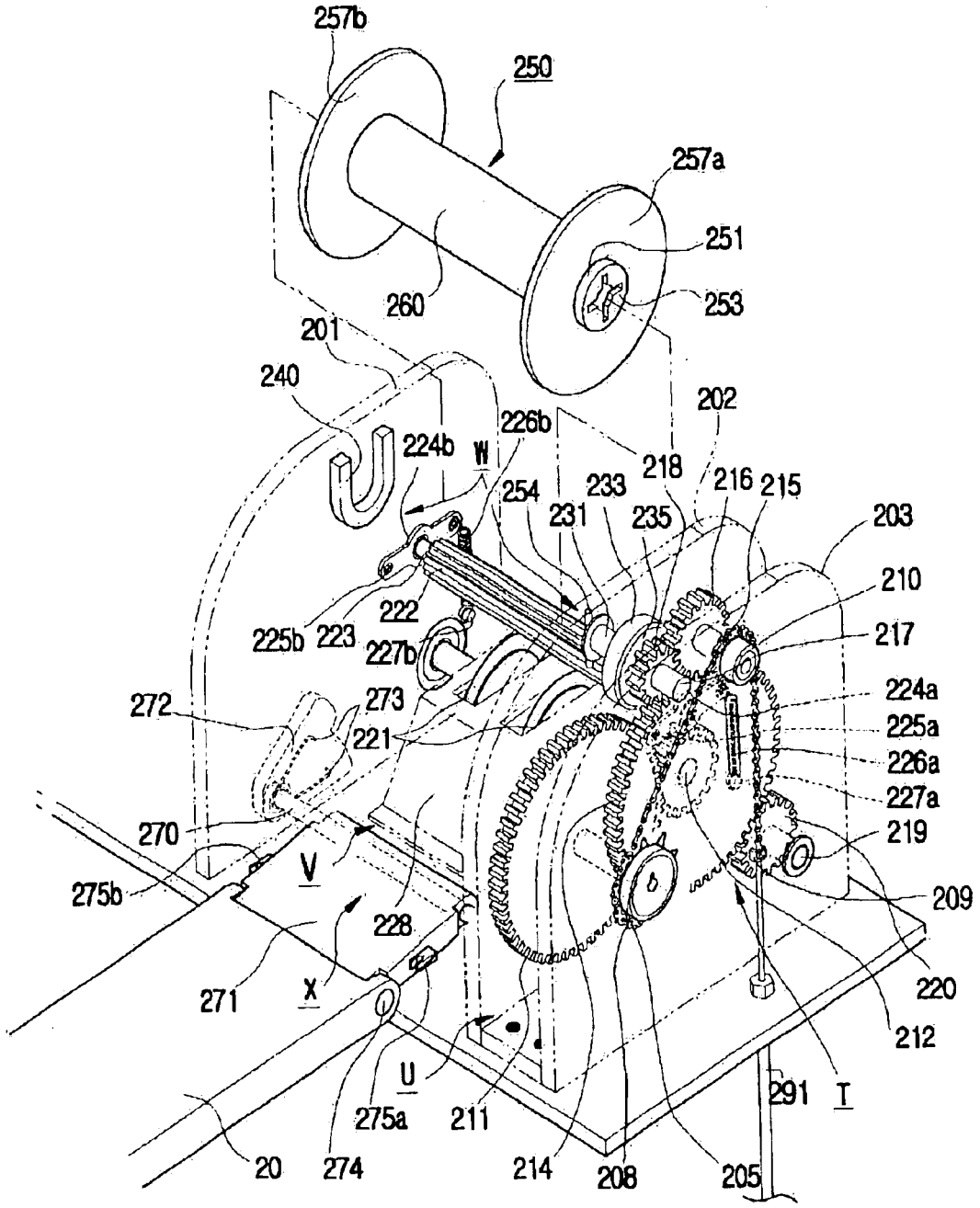
FIG. 6 is a perspective view for illustrating construction and operation of a sheet collector of a sheet winding machine for a toilet stool of FIG. 5.

As shown in FIG. 5 and FIG. 6, a sheet winding machine for a toilet stool according to an modified example of the first embodiment of the present invention comprises, in a toilet stool 10 having a seat 20 and an under plate 30 that is installed at a rear end of the toilet seat 20 mounted on the toilet stool 10, a sheet supplier 100 and a sheet collector 200 mounted on opposite ends of the under plate 30, like the first embodiment. A cover 300 covers the sheet supplier 100 and the sheet collector 200.

In the sheet supplier 100, a first and a second support 101, 102 are positioned at both side of the under plate 30, and a sheet supply roll 110 is releasably positioned at an upper side of the first and the second support 101, 102. A guide bar 120 is positioned at a rear lower side between the first and the second support 101, 102. The guide bar 120 prevents the sheet S from being loosened or twisted due to a rotation of the sheet roll 110 when the sheet S is drawn onto the seat 20, thereby making the sheet S drawn tightly onto the seat.

In the sheet collector 200, a first and a second support plate 201, 202 are positioned at both sides of the under plate 30, and a third support plate 203 is positioned at a side of the second support plate 202. Additionally, the sheet collector 200 comprises, as like the first embodiment, driving force transferring means (T), driving force switching and transferring means (U), sheet feeding means (V), sheet winding means (W), seat lift means (X), and a pedal device (Y).

A detail construction of the components of the sheet collector 200 is described as follows.

Figure 7:
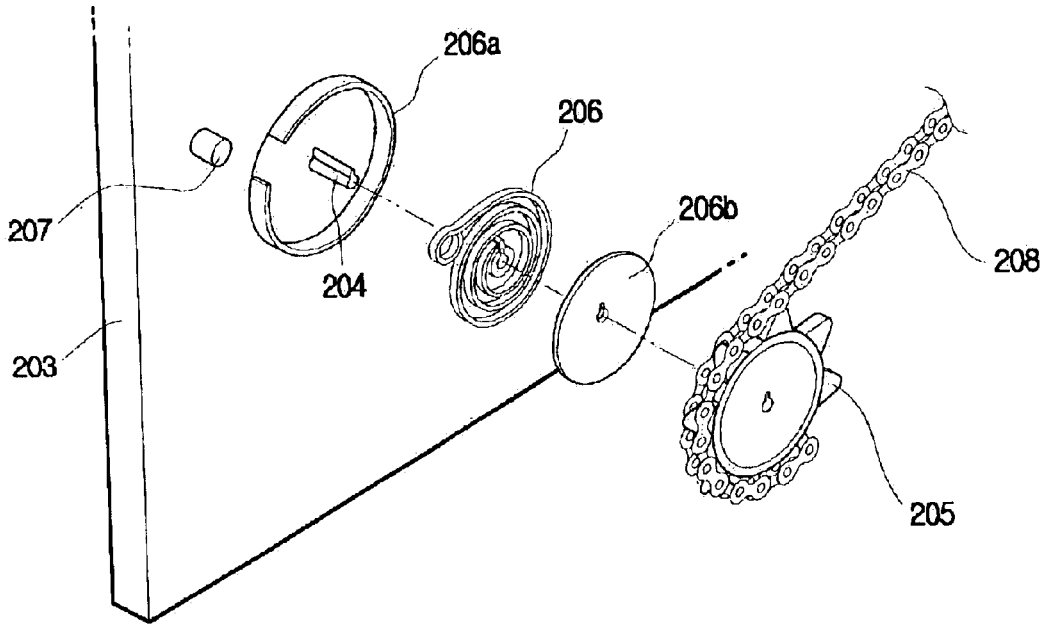
FIG. 7 is a perspective view for illustrating a winding spring and a rotating sprocket at the sheet winding machine for a toilet stool of FIG. 5.

First, the driving force transferring means (T) is mounted, as shown in FIG. 5 and FIG. 7, at an external rear upper side of a third support plate 203 with a support sprocket 210 for axially rotating around a shaft 215 and disposed at an external front lower side with a rotating sprocket 205 for axially rotating around a first axle 204. The first axle 204 supports the rotation sprocket 205 and a spiral spring 206 which are separated from each other by a separation plate 206*b* and are fixed in a spring casing 206*a*.

An end of the spiral spring 206 is fixed to a fixer 207 positioned at an outer surface of the third support plate 203, and the other end thereof is fixed to a hole positioned in the separation plate 206*b*. A rim of the rotation sprocket 205 is engaged with the links of a chain. 208, and an end of the chain 208 is fixed to an inside of the rotation sprocket 205, and the other end is engaged with the supporting sprocket 210 to be connected to a cable 291 through a connector 209. Additionally, the rotation sprocket 205 is internally provided with a latchet gear (not shown) which transfers a drive force to the first axle 204 only in a direction and races in an opposite direction.

Figure 8:
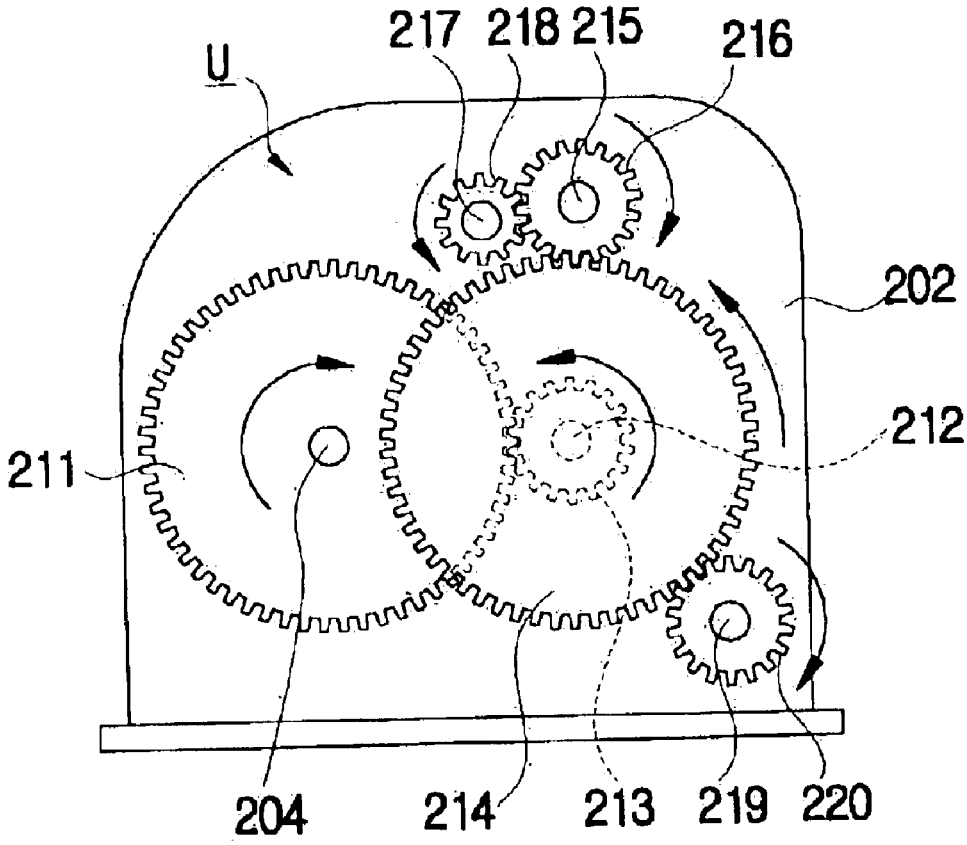
FIG. 8 is a side view for illustrating a meshed gear state of driving force switching and transferring means of a sheet winding machine for a toilet stool of FIG. 5.
Figure 9:
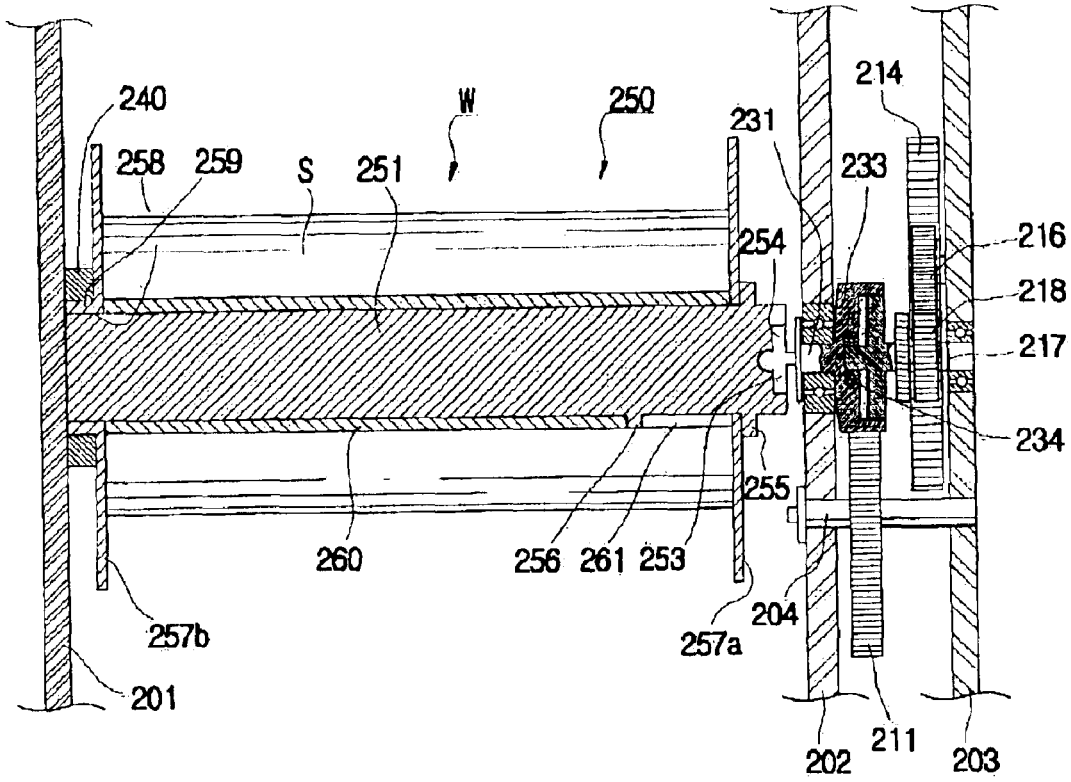
FIG. 9 is a cross-sectional view for illustrating a coupled state of sheet winding means at a sheet winding machine for a toilet stool of FIG. 5.
Figure 10:
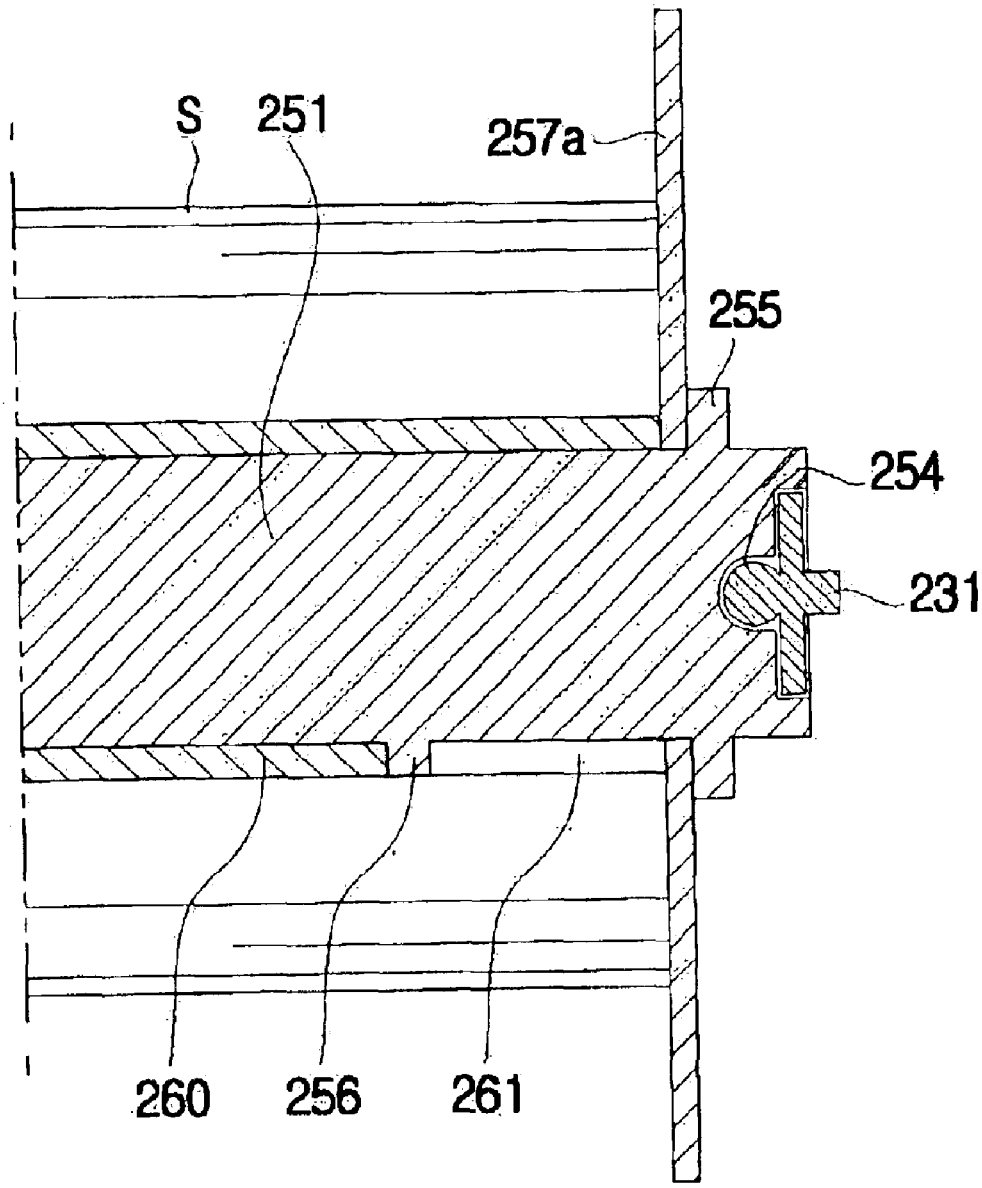
FIG. 10 is a cross-sectional view for illustrating a coupled state of one side of a shaft at a sheet winding roll of a sheet winding machine for a toilet stool of FIG. 5.
Figure 11:
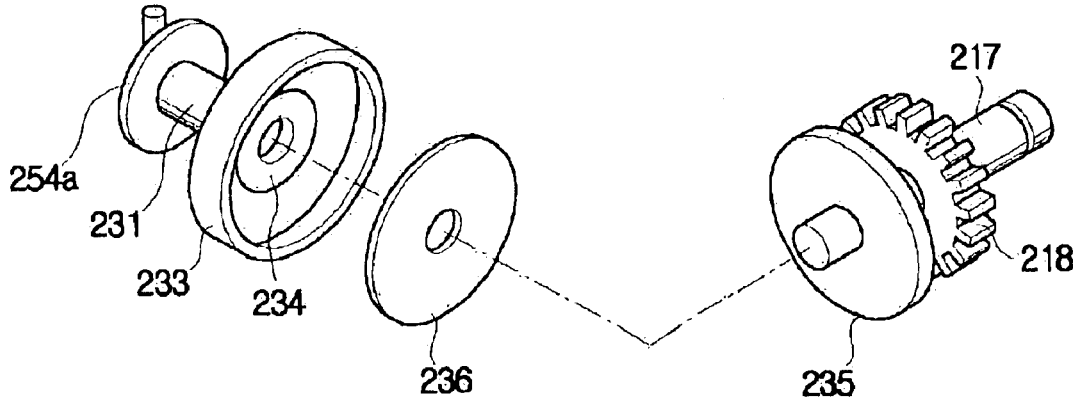
FIG. 11 is an exploded perspective view for illustrating a device for generating a slip at a sheet winding roll of a sheet winding machine for a toilet stool of FIG. 5.
Figure 12:
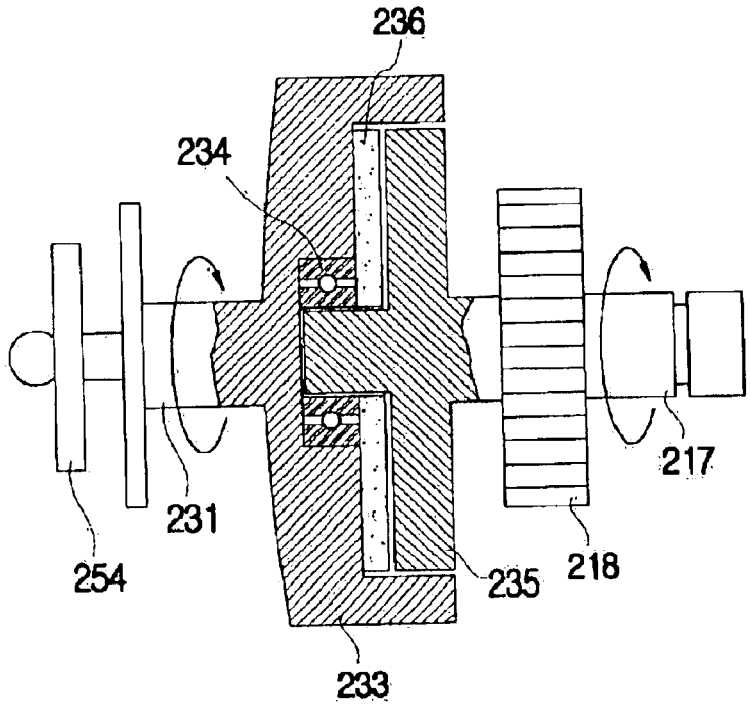
FIG. 12 is a cross-sectional view for illustrating a coupled state of a slip preventing device of FIG. 11.

The driving force switching and transferring means (U) is, disposed, as shown in FIG. 5, FIG. 6 and FIG. 8, with a driving gear 211 axially mounted at a first axle 204 which is the same axle as the axle mounted with the rotating sprocket 205, where the driving gear 211 is axially connected at one side thereof to a first transmission gear 213 via a second axle 212 to thereafter be meshed to the driving gear 213 and a second axle 212, which is the same axle as that of the first transmission gear 213, is axially connected to a second transmission gear 214. On an upper side of the second transmission gear 214, an upper driven gear 216 is meshed to the second transmission gear 214 via a shaft 215 and a winding gear 218 is axially connected to a lateral surface of the upper driven gear 216 via a third axle 217 but distanced from the second transmission gear 214 and meshed to the upper driven gear 216. The second transmission gear 214 is axially mounted at a lower side thereof to a lower driven gear 220 via a fourth axle 219 to be meshed to the second transmission gear 214. The fourth axle 219 is horizontally and rotatively mounted among first, second and third support plates 201, 202 and 203.

Figure 16:
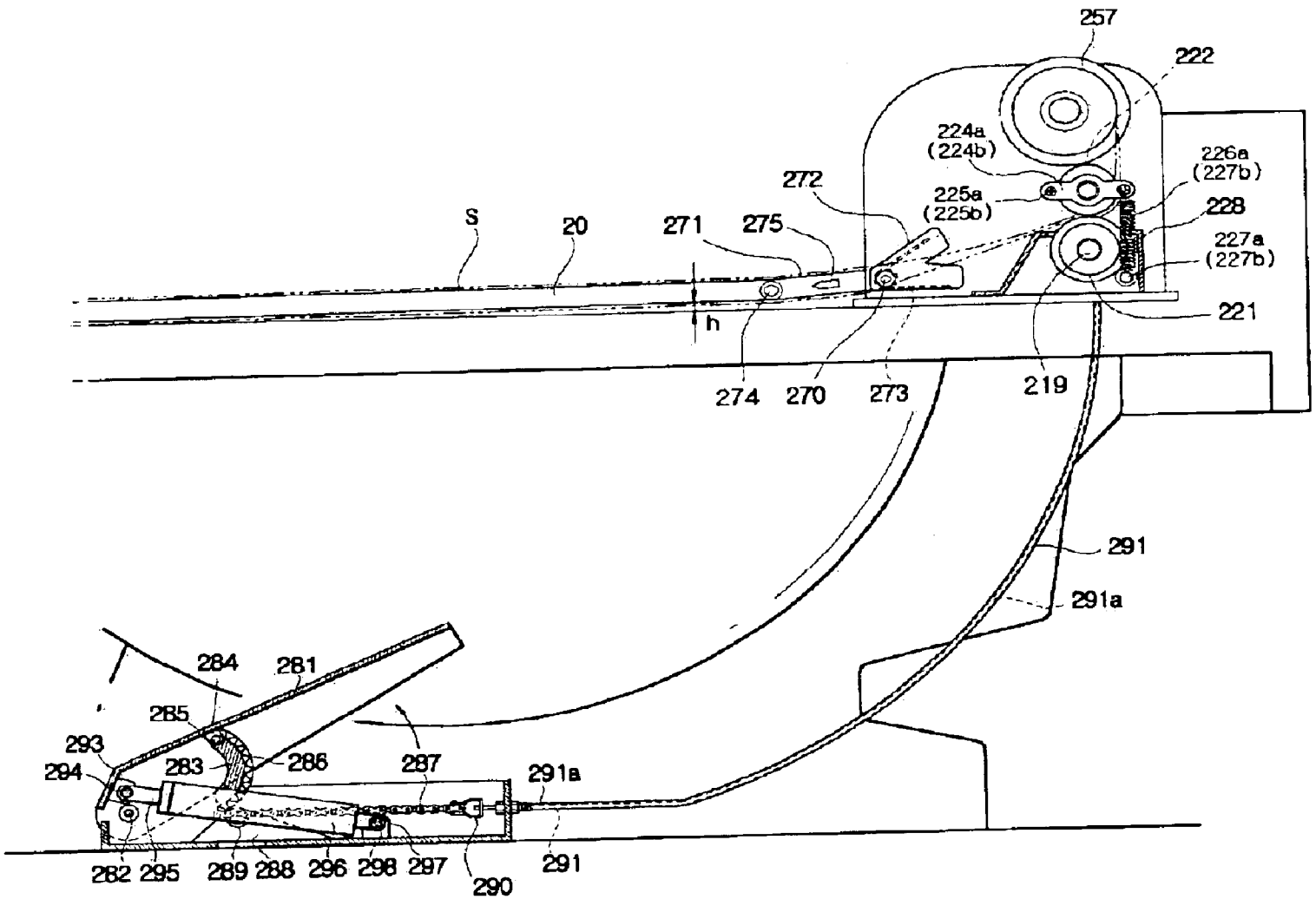
FIG. 16 is a side view for illustrating a sheet winded state of a sheet winding machine for a toilet stool of FIG. 5.

The sheet feeding means (V), as shown in FIG. 6 and FIG. 16, a rotating roller 221 is axially connected to an mid-section of a fourth axle 219 which is the same axle to which a lower driven gear 220 is connected. A rotating roller 221 is axially connected thereon via a fifth axle 223 to a contact roller 222 which is simultaneously rotated by a turning effect of the rotating roller 221 by being contacted to the rotating roller 30. The fifth axle 223 is connected at both ends thereof to levers 224*a* and 224*b*. The levers 224*a* and 224*b* are rotatively connected to inner wall of the first and second support plates 201 and 202 via rotation axles 225*a* and 225*b*, and are connected thereunder to tension springs 226*a* and 226*b*. Ends of the coiled spring 226*a*, 226*b* are respectively connected to fixers 227*a*, 227*b* which are positioned at a rear lower side of the first and the second support plate 201,202. Between the rotating roller 221 and the contact roller 222, a guide panel 228 is fixed to the under plate 30 for preventing the sheet S from being loosened or twisted, and a portion of the rotating roller 221 is projected towards the outside of an opening of the guide panel 228.

In the sheet winding means (W), a letter-l shaped lock 254 is positioned with a sixth axle 231 at an upper side of the second support plate 202, and a bearing housing 233 is engaged with the sixth axle 231, and the bearing housing 233 is provided with a bearing 234 having a through hole at its center, as shown in FIG. 6 and FIGS. 9 to 12. On the third axle 217, which is the same axle as the axle for the winding gear 218, there is axially mounted a steel disc 235 having a protruder to be inserted to the through hole of the bearing 234. Between the bearing 234 and the steel disc 235 there is inserted a resin circular plate 236 having a penetration central part in order to provide a slide between the bearing 234 and the steel disc 235. At an upper side of the first support plate 201 there is formed a sheet-releasable groove 240 of a U shape opposite to the lock 254, as shown in FIG. 6. A sheet winding roll 250 is releasably attached to the sheet-releasable groove 240 and the lock 254. The sheet winding roll 250 is provided with a shaft 251 at its center. An insertion groove 253 of a cross shape is formed to be engaged with the lock 254 at a side of the shaft 251, and a releasable unit is formed to be attached/detached to/from the U shaped releasable groove 240 at the other side of the axle.

At a side of the shaft 251 there is projectingly formed a catching piece 255 and a catching pin 256. At a side of the catching piece 255 of the shaft 251 there is fixedly positioned a side plate 257*a*, and a volt unit 258 is formed at a front end of the other side of the shaft 251. With the volt unit 258 is engaged a releasable side plate 257*b* having a nut unit 259. To the shaft 251 is releasably inserted a paper pipe 260 to which the collected sheet is to be wounded, and a front end of the paper pipe 260 is provided with an insertion groove 261 to be inserted to the catch pin 256. However, the paper pipe 260 to be inserted to the shaft 251 can be omitted, and the sheet S can be directly wounded on the shaft 251. Additionally, the lock 254 and the insertion groove 253 can be a cross shape or a polygonal shape other than the above l shape.

The toilet seat lift means (X) is disposed, as shown in FIG. 6 with a lifter 271 via a support axle 270 between the first and the second support plates 201 and 202. At a front lower end of the first support plate 201, a support panel 272 is penetrated by the support axle 270. Ends of a tensile spring 273 are fixed to a rear lower side of the support panel 272 and an outer front end of the first support plate 201. The lifter 271 is connected at a front tip end thereof via a connecting shaft 274 to the toilet seat 20, and the front tip end surface of the lifter 271 and the tip end surface of the toilet seat 20 are contacted with the under plate 30 by the rotation of the support axle 270. The lifter 271 is secured at both ends thereof with knives 275*a* and 275*b* for cutting sheets.

Figure 13:
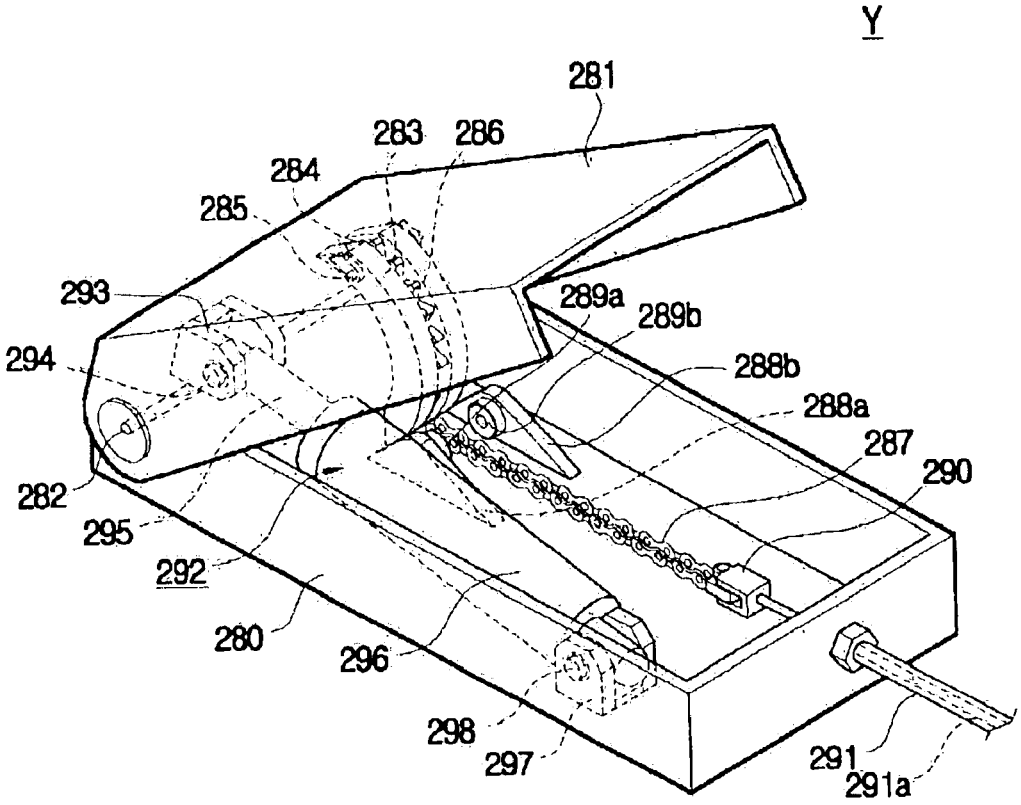
FIG. 13 is a perspective view for illustrating a pedal device of a sheet winding machine for a toilet stool of FIG. 5.
Figure 14:
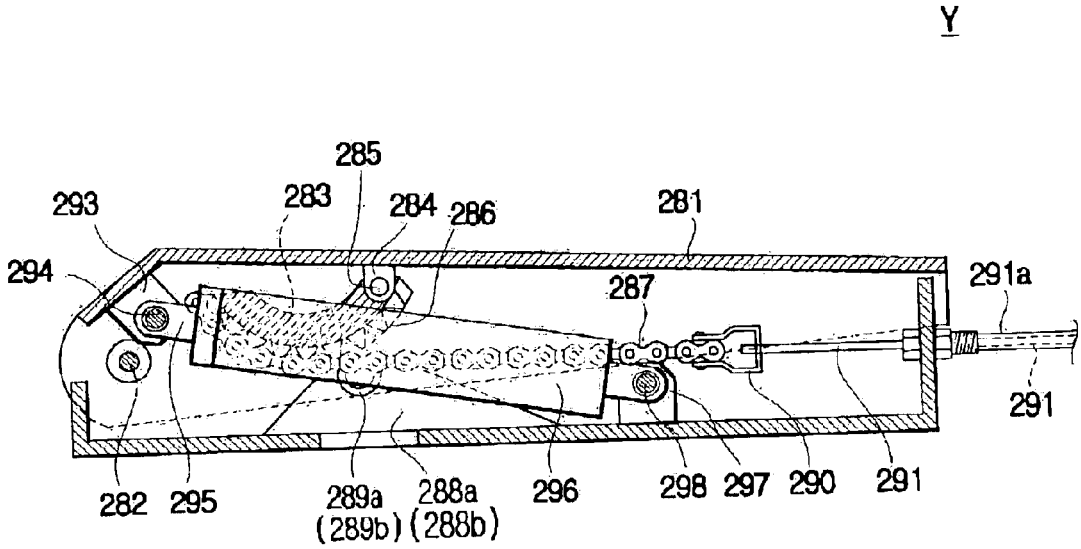
FIG. 14 is a cross-sectional view for illustrating an abutted state of a pedal part to a pedal device of FIG. 13.

The pedal device Y comprises a base plate 280 and a pedal unit 281 engaged with an end of the base plate 280 by a hinge axle 282, as shown in FIG. 13 and FIG. 14. At an internal side of the pedal unit 281, an arc press pad 283 is positioned to be rotated by a first hinge piece 284 and a first hinge axle 285. The arc pressing pad 283 is formed at a central external surface thereof with a sprocket 286 and is connected at a tip end thereof with a chain 287. The floor of the base plate 280 at a lower side of the arc press pad 283 is axially connected at both sides thereof to bearings 289*a* and 289*b* which are rotated with outer sides of the arc press pad 283 by support frames 288*a* and 288*b*. The other tip end side of the chain 287 is connected via a connector 290 to the cable 291. A tube 291*a* is covered on the cable 291. At an internal front side of the pedal unit 281, a front end of a piston 295 of a cylinder unit 292 for the oil pressure cylinder unit 292 for preventing an excessive force from applying to the pedal unit 281 is positioned to be rotated by the second hinge piece 293 and the second hinge axle 294, Above a bottom of the base plate 280, a front end of the cylinder 296 of the oil pressure cylinder unit 292 is positioned to be rotated by the third hinge piece 297 and the third hinge axle 298.

Figure 17:
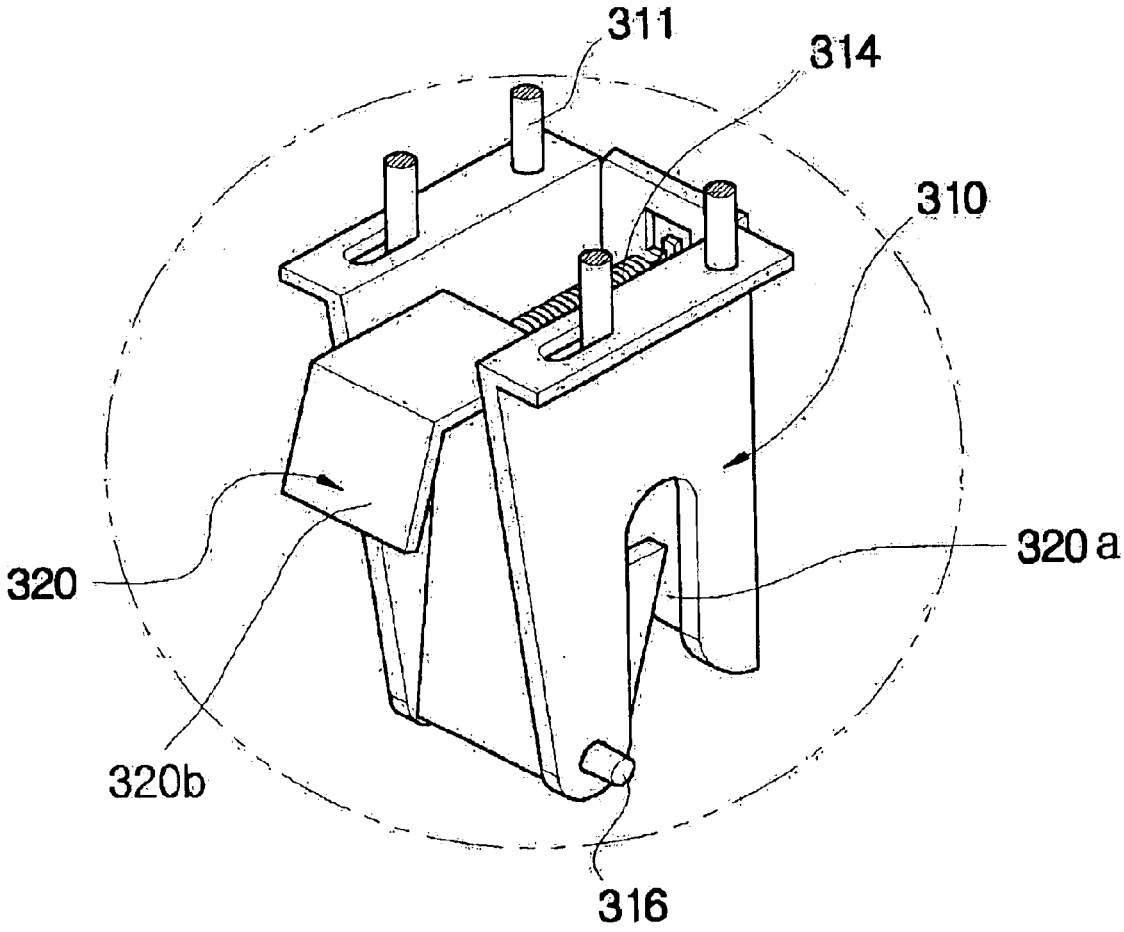
FIG. 17 is an enlarged view of A part of FIG. 5.

As shown in FIG. 5 and FIG. 17, the cover 300 has a coupling unit 310 for being coupled with a coupling bar 130 positioned between the second support 102 of the sheet supplier 100 and the first support plate 201 of the sheet collector 200. An upper part of the coupling unit 310 is supported by a plural of support means 311 positioned in the cover 300, and its lower part has a guide insertion groove 312 for engaging with the coupling bar 130. Additionally, the coupling unit 310 has a catch lever 320 rotationally mounted around a shaft 316 positioned at a side of the guide insertion groove 312. The catch lever 320 has a locking unit 320*a* and an absorbing unit 320*b* which are rotationally moved into/from the guide insertion groove 312 around the shaft 316 by a magnetic member, and the catch lever is mounted in a direction in which the locking unit 320*a* is moving into the guide insertion groove 312 by an extension spring 314. When the coupling bar 130 is inserted in the guide insertion groove 312, the coupling bar 130 is inserted by pressing the locking unit 320*a*. When the bar passes an end of the locking unit 320*a*, the locking unit 320*a* is restored to its original position by a force of the extension spring 314 to lock the coupling bar 130.

Meanwhile, in order to release the locking, a magnet is contacted with an external side of the cover 300, and thereby the absorbing unit 320*b* is absorbed by a magnetic force of the magnet to withdraw the locking unit 320*a* from the guide insertion groove 312. The cover 300 can be released from the coupling bar 130 in the above absorption state.

Now, operation and effects of the sheet winding machine for a toilet stool of the second embodiment thus constructed will be described.

Figure 15:
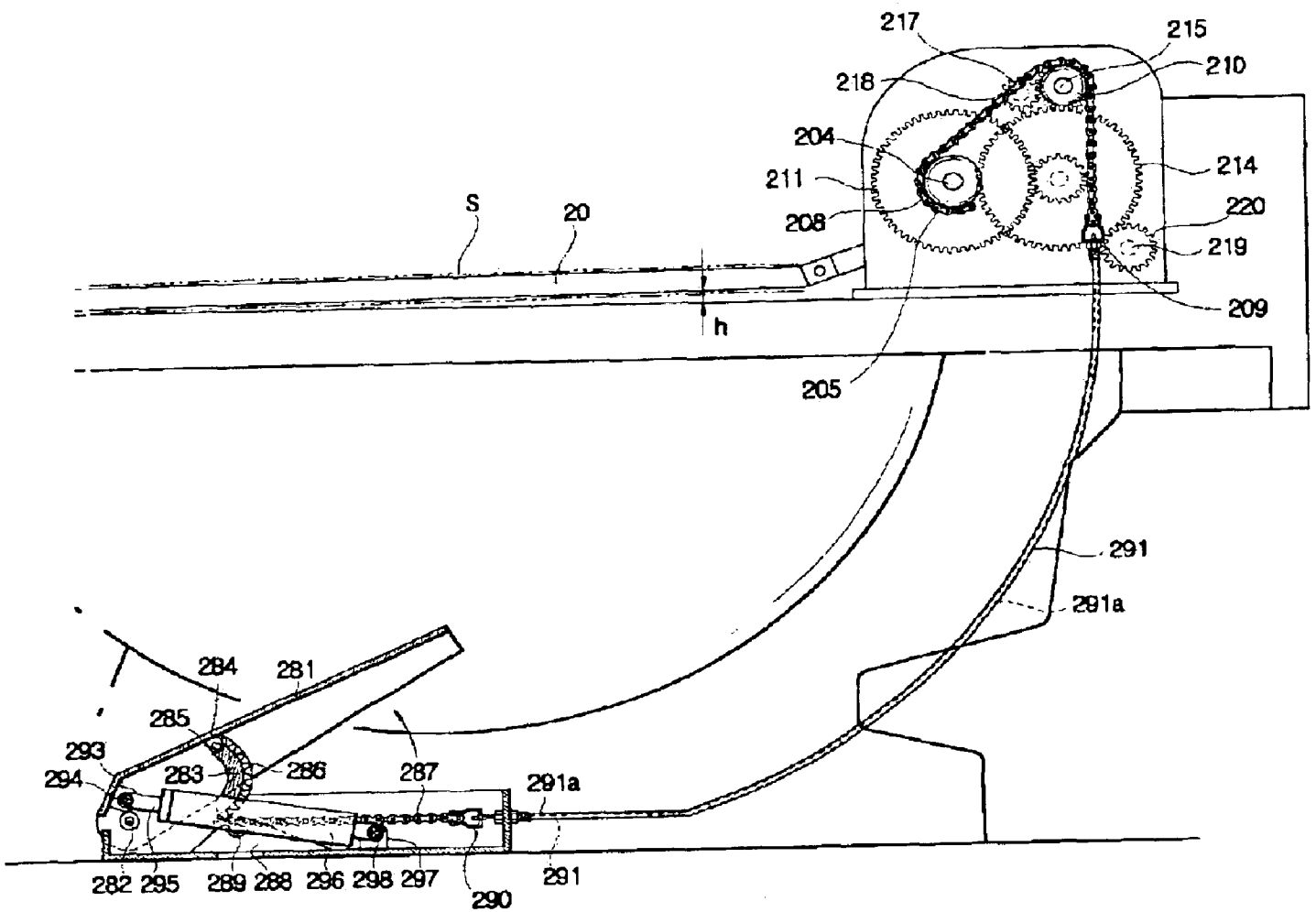
FIG. 15 is a side view for illustrating a mounted state of a sheet winding machine for a toilet stool of FIG. 5.

First, as shown in FIG. 5 and FIG. 6, while sheets (S) are placed via the toilet seat 20 on the sheet winding roll 250 of the sheet collector 200 and on the sheet supplier 100, a user steps on the pedal unit 281 of the pedal device (Y) in order to use the toilet stoll 10, as shown in FIG. 15 and FIG. 16.

As shown in FIG. 14, the pedal unit 281 rotates downwards on the hinge axle 282, while contacting with the piston 295 and the cylinder 296 of the oil pressure cylinder unit 292. At the same time, the arc press pad 283 is also moved down.

The arc press pad 283 rotates down on the hinge axle 282 with its both sides contacted with the bearings 289*a*, 289*b*, and at the same time the press pad draws the chain 287 and winds the chain on the sprocket 289 to draw the cable 291. The oil pressure cylinder unit 292 operates with a uniform force even when an excessive force is applied to the pedal unit 281, thereby preventing overload from applying to the driving force transferring means T and the driving force switching and transferring means U.

As shown in FIG. 5 to FIG. 8, FIG. 12, FIG. 15 and FIG. 16, according as the cable 291 is pulled by the action of the pedal device (Y), the chain 208 is pulled. In this case, the chain 208 is pulled toward the pulling direction being supported by the support sprocket 210 to rotate the rotating sprocket 205. When the rotating sprocket 205 is rotated clockwise, the driving gear 211 axially connected to the first axle 204 which is the same axle of the sprocket is also rotated. When the driving gear 211 is rotated, the first transmission gear 213 is rotated to the opposite direction of the driving gear 211, and the second transmission gear 214 is rotated by the rotation of the first transmission gear 213 on the second axle 212. In this time, the upper driven gear 216 and the lower driven gear 220 meshed to the upper and lower sides of the second transmission gear 214 are respectively rotated in the opposite direction of the second transmission gear 214.

When the rotating roller 221 is rotated, the contact roller 222 which contacts therewith is also rotated and the sheet (S) is cut by the knives 275*a* and 275*b* of the lifter 271 and pulled from the toilet seat 20 along the guide panel 228 by the turning effect and adhering force of the rotating roller 221 and the contact roller 222 to be fed to the rear and to be supplied to the sheet winding roll 250. In this case, levers 224*a*, 224*b* rotate on the rotation axles 225*a*, 225*b* by tensile forces of the tensile springs 226*a*, 226*b* to move the contact roller 222 downwards and bring the roller into contact with the rotating roller 221. The winding gear 218, which is engaged with the upper driven gear 216, rotates by the rotation of the rotating roller 221, and then the steel disc 235 on the third axle 217 rotates, and the bearing housing 233 having the bearing 234 rotates. Following the rotation of the housing 23, the lock 254 on the sixth axle 231, the same axle as the axle of the housing, rotates.

Accordingly, the sheet S to be wounded on the paper pipe 260 is tightly wounded and is hard to come loose, thereby have a nice wind state. Additionally, a tensile strength of the sheet S is designed to be larger than an attraction force between the bearing housing 233 and the steel disc 235 to make the sheet S wounded on the sheet winding roll 250 without having any damage. Accordingly, an exact amount of the sheet S laid on the seat 20 is wounded on the roll.

Meanwhile, the pedal unit 281 and the arc-shaped press pad 283 are restored to an original state by a pressure of the oil pressure cylinder 292 when the user takes off his foot from the pressed pedal unit 281. Additionally, in the case of the rotation of the rotation sprocket, the rotation sprocket races by a tensile force of the extended spiral spring 206 and by the latch (not shown) positioned between the first axle 204 and the rotation sprocket 205. Therefore, the sheet S wounded on the paper pipe 260 of the sheet winding roll 250 does not come loose. When the paper pipe 260 reaches its winding limit to accept no more sheet S, an end of the sheet winding roll 250 is lifted up from the sheet releasable groove 240 of the first support plate 201, and then the insertion groove 253 of the sheet winding roll 250 is separated from the lock 254 to release the sheet releasable roll. Then, the releasable side plate 257*b* engaged with the shaft 251 is released from the roll, and the paper pipe 260 is taken out from the shaft 251 to make the sheet S collected and cast. Successively, a small amount of sheet S is wounded on the pipe or tape is attached to the pipe to be again inserted to the shaft 251. The insertion groove 261 on the paper pipe 260 is inserted into the catch piece 255 of the shaft 251. A method for mounting the sheet winding roll 250 between the first and the second support plate 201, 202 is performed in the reverse order of the above release method. Additionally, due to the side plate 257*a* and the releasable side plate 257*b* at both sides of the shaft 251, the sheet S is wounded tidily. The paper pipe 260 inserted to the shaft 251 is also rotated in the case of the rotation of the shaft 251 by the coupling of the catch pin 256 and the insertion groove 261, thereby making the sheet to be wounded.

When the sheet provider 100 at the left side of the toilet stool 10 is short of sheets, the paper pipe 260 is separated from the support 101, 102 and a new paper pipe 260 having new sheet S wounded is mounted.

Meanwhile, when a user sits down on the seat 20 to use the toilet stool 10, a front end of the seat 20 contacts the under plate 30 by a connection axle 274 positioned in the lifter 271. A front end of the lifter 271 having the penetration supporting axle 270 contacts the under plate 30 by the rotation of the supporting axle 270, thereby giving comfort for the user.

Thereafter, when the user gets up from the seat 20 after use, the supporting axle 270 reversely rotates by a resilient force of the spring 273 positioned on the first support plate 201 and the supporting panel 272. Then, the seat 20 and the lifter 271 being contact with the under plate 30 are separated from an upper end of the toilet stool 20 by a certain height h, as shown in FIG. 15 and FIG. 16. In the case that the sheet S is collected to the sheet winding roll 250 by pressing the pedal unit 281, a frictional force between the upper end of the toilet stool 10 and the seat 20 is removed, thereby making the operation of collection being smooth.

Therefore, in the sheet winding machine for a toilet stool according to the second embodiment, the driving force transferring means of the sheet collector has simple construction compared with the first embodiment, and so its manufacture is easy and an operation of its sheet feeding means and the pedal unit are more reliable.

Additionally, the sheet winding machine for a toilet stool of the second embodiment of the present invention is operated with a uniform pressure even when an excessive force is applied to the pedal unit, thereby minimizing failure rates. The guide panel of the sheet feeding means of the present invention prevents the sheet for being twisted or stuck, thereby making the winding operation smooth.

As described above, the present invention can use a high storing capacity of sheets, and allows each user to place a sanitary sheet on the seat.

What is claimed is:

1. A sheet winding machine for a toilet stool, the machine comprising:

a sheet supplier and a sheet collector mounted on opposite ends of an under plate, said under plate being installed at a rear end of a toilet seat mounted on a toilet bowl, wherein the sheet supplier comprises first and second supports mounted at both sides of the under plate and a sheet supply roll releasably mounted at an upper side between the first and the second supports, wherein the sheet collector comprises first and second support plates at both sides of the under plate; a third support plate laterally mounted at the second support plate; driving force transferring means mounted at an external side of the third support plate with a plurality of sprockets and chains; driving force switching and transferring means meshed via a plurality of gears between the second and the third support plates; sheet feeding means so mounted as to allow a rotating roller and a contact roller to abut between the first and the second support plates; sheet winding means mounted at an upper side between the first and the second support plates for a sheet winding roll to be releasably operated; toilet seat lift means mounted at a front side of the sheet feeding means to allow a lifter to be operated; and a pedal device connected to the driving force transferring means to provide a driving force to the sheet feeding means and the sheet winding means.

2. The sheet winding machine for a toilet stool according to claim 1, wherein the supplier further comprises a guide bar mounted at a rear lower side between the first and the second supports.

3. The sheet winding machine for a toilet stool according to claim 1, wherein at least one of the plural sprockets of the driving force transferring means has a spiral spring for allowing the sprocket to be restored to its original state after rotating by a driving force of the pedal device.

4. The sheet winding machine for a toilet stool according to claim 1, wherein the driving force switching and transferring means comprises a driving gear axially mounted at a first axle which is the same axle as the axle mounted with the rotating sprocket;

a first transmission gear axially connected to the driving gear at one side thereof via a second axle;

a second transmission gear axially connected to a second axle, which is the same axle as that of the first transmission gear;

a shaft connected to an upper side of the second transmission gear;

an upper driven gear meshed to the second transmission gear via the shaft;

a winding gear axially connected to a lateral surface of the upper driven gear via a third axle; and a lower driven gear meshed to the second transmission gear via a fourth axle at a lower side of the second transmission gear, but distanced from the second transmission gear and meshed to the upper driven gear.

5. The sheet winding machine for a toilet stool according to claim 1, wherein the sheet feeding means comprises a rotating roller axially connected to an mid-section of the fourth axle; a contact roller connected via a fifth axle which is simultaneously rotated by a turning effect of the rotating roller by being contacted to the rotating roller; a lever connected via the fifth axle at both ends of the fifth axle with its end rotating on the rotating axle; and tension springs respectively connected to the other end of the lever and fixers at rear lower sides of the first and the second supports.

6. The sheet winding machine for a toilet stool according to claim 5, wherein the sheet feeding means further comprises a guide panel which is fixed between the rotating roller and the contact roller, the guide panel having an opening for allowing an upper portion of the rotating roller to be exposed.

7. The sheet winding machine for a toilet stool according to claim 1, wherein the sheet winding means comprises a sheet winding roll having a releasable part at one end thereof to be mounted on a U shaped sheet releasable groove in an internal side of the first support plate and an insertion groove, at the other end thereof, to rotate with a lock which is formed on an internal side of the second support plate opposite to the internal side of the first support plate.

8. The sheet winding machine for a toilet stool according to claim 7, wherein the sheet winding means comprises a magnetic housing mounted on the sixth axle having lock thereon; a magnet inserted to the magnetic housing; a steel disc mounted via the third axle for being absorbed to the magnet; and a circular plate inserted between the magnetic and the steel disc.

9. The sheet winding machine for a toilet stool according to claim 7, wherein the sheet winding roll has a shaft at a center thereof and a side plate and a releasable side plate at both sides of the shaft.

10. The sheet winding machine for a toilet stool according to claim 9, wherein a projected catch pin is formed on the shaft, a paper pipe having an insertion groove for the catch pin is releasably inserted to the shaft.

11. The sheet winding machine for a toilet stool according to claim 1, wherein the toilet seat lift means comprises a lifter mounted via a support axle between the first and the second support plates, the support panel which is mounted at an outer front lower side of the first support plate with an end of the panel penetrated via the support axle, a tensile spring fixed to a rear lower side of the support panel and an outer front end of the first support plate.

12. The sheet winding machine for a toilet stool according to claim 11, wherein a front end of the lifter is connected to the seat by a connecting axle, and knives are fixed at both sides of the lifter.

13. The sheet winding machine for a toilet stool according to claim 1, wherein the pedal device comprises a base plate; a pedal unit engaged with an end of the base plate by a hinge axle; an arc press pad mounted at an internal side of the pedal unit to be rotated by a first hinge piece and a first hinge axle; and an oil pressure cylinder unit of which a front end of a piston mounted on an internal front side of the pedal unit to be rotated on the second hinge piece and the second hinge axle and a front end of a cylinder is mounted on a floor of the base plate to be rotated on the third hinge piece and the third hinge axle.

14. The sheet winding machine for a toilet stool according to claim 13, wherein the arc press pad is formed at a central external surface thereof with a sprocket and is connected at a tip end thereof with a chain and the arc press pad is rotated with the support frame and the bearing positioned at both sides of a floor of a base plate under the arc press pad.

* * * * *